US009886823B2

(12) United States Patent
Roukis

(10) Patent No.: US 9,886,823 B2
(45) **Date of Patent: *Feb. 6, 2018**

(54) GAMING SYSTEM AND A METHOD OF GAMING

(71) Applicant: Aristocrat Technologies Australia Pty Limited, North Ryde, NSW (AU)

(72) Inventor: George Roukis, Miranda (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/131,711

(22) Filed: Apr. 18, 2016

(65) Prior Publication Data

US 2016/0253879 A1 Sep. 1, 2016

Related U.S. Application Data

(63) Continuation of application No. 12/242,166, filed on Sep. 30, 2008, now Pat. No. 9,342,946.

(30) Foreign Application Priority Data

Oct. 1, 2007 (AU) ..... 2007905348

(51) Int. Cl.
*G07F 17/34* (2006.01)
*G07F 17/32* (2006.01)

(52) U.S. Cl.
CPC ..... *G07F 17/34* (2013.01); *G07F 17/32* (2013.01); *G07F 17/3213* (2013.01); *G07F 17/3267* (2013.01); *G07F 17/3258* (2013.01)

(58) Field of Classification Search
CPC .. G07F 17/32; G07F 17/3213; G07F 17/3267; G07F 17/3258; G07F 17/34
See application file for complete search history.

(56) References Cited

U.S. PATENT DOCUMENTS

| | | | |
|---|---|---|---|
| 6,932,340 | B1 | 8/2005 | Schaefer et al. |
| RE39,644 | E | 5/2007 | Alcorn et al. |
| 2002/0042294 | A1 | 4/2002 | Pau et al. |
| 2003/0060282 | A1 | 3/2003 | Suzuki |
| 2004/0018874 | A1 | 1/2004 | Bonney et al. |
| 2004/0053680 | A1 | 3/2004 | Schultz |
| 2004/0072608 | A1 | 4/2004 | Toyoda |
| 2004/0152507 | A1 | 8/2004 | Baerlocher et al. |
| 2004/0204223 | A1 | 10/2004 | Cuddy et al. |
| 2004/0214632 | A1 | 10/2004 | Cuddy et al. |
| 2004/0242302 | A1 | 12/2004 | Baerlocher |
| 2005/0009601 | A1 | 1/2005 | Manfredl et al. |

(Continued)

FOREIGN PATENT DOCUMENTS

| | | |
|---|---|---|
| CN | 1858759 | 11/2006 |
| EP | 1199689 | 4/2002 |

(Continued)

*Primary Examiner* — Werner Garner
(74) *Attorney, Agent, or Firm* — McAndrews, Held & Malloy, Ltd.

(57) ABSTRACT

A method of gaming comprising: conducting a base game; modifying a current value of a feature counter by a random value in response to a designated counter event occurring in the base game; determining whether the current value of the feature counter corresponds to one of a plurality of feature games in response to a feature trigger event occurring; and conducting any feature game to which the current value of the feature counter corresponds.

20 Claims, 8 Drawing Sheets

(56) References Cited

U.S. PATENT DOCUMENTS

| | | | |
|---|---|---|---|
| 2005/0049029 | A1 | 3/2005 | Gazdic et al. |
| 2005/0148382 | A1 | 7/2005 | Fox |
| 2005/0250578 | A1 | 11/2005 | Siomiany et al. |
| 2006/0111178 | A1 | 5/2006 | Gallaway et al. |
| 2006/0205491 | A1 | 9/2006 | Daley |
| 2006/0252501 | A1 | 11/2006 | Little et al. |
| 2006/0258437 | A1 | 11/2006 | Osawa |
| 2007/0093297 | A1 | 4/2007 | Moshal |
| 2007/0099692 | A1 | 5/2007 | Hishinuma et al. |
| 2007/0111783 | A1 | 5/2007 | Cuddy et al. |
| 2007/0168462 | A1 | 7/2007 | Grossberg et al. |
| 2008/0004101 | A1 | 1/2008 | Hein et al. |
| 2008/0113779 | A1 | 5/2008 | Cregan |
| 2009/0011830 | A1 | 1/2009 | Wang et al. |
| 2009/0170593 | A1 | 7/2009 | Pacey |

FOREIGN PATENT DOCUMENTS

| | | |
|---|---|---|
| GB | 2410696 | 8/2005 |
| GB | 2430388 | 6/2008 |
| MX | PA03003355 | 12/2004 |
| TW | 262813 | 10/2006 |
| WO | 2003028818 | 4/2003 |
| WO | 2004038551 | 5/2004 |
| WO | 2006039349 | 4/2006 |
| WO | 2006039366 | 4/2006 |
| WO | 2006130611 | 12/2006 |
| WO | 2007008116 | 1/2007 |
| WO | 2007011915 | 1/2007 |
| WO | 2007022559 | 3/2007 |
| WO | 2007084967 | 7/2007 |

GAMING SYSTEM AND A METHOD OF GAMING

RELATED APPLICATION

This application is a continuation of U.S. application Ser. No. 12/242,166 having a filing date of Sep. 30, 2008, which claims priority to Australian Provisional Patent Application No. 2007905348 having a filing date of Oct. 1, 2007, which is hereby incorporated by reference herein in its entirety.

FIELD OF THE INVENTION

The present invention relates to a gaming system, a method of gaming, a game controller and computer program code.

BACKGROUND TO THE INVENTION

Many gaming machines provide a feature game which is triggered in response to a trigger event occurring in a base game. Such feature games often award more prizes or higher prizes than the base game or are "free" in the sense that no further investment is required by the player to play the feature game.

While such gaming machines provide users with enjoyment, a need exists for alternative gaming systems in order to maintain or increase player enjoyment.

SUMMARY OF THE INVENTION

In a first aspect the invention provides a method of gaming comprising:

conducting a base game;

modifying a current value of a feature counter by a random value in response to a designated counter event occurring in the base game;

determining whether the current value of the feature counter corresponds to one of a plurality of feature games in response to a feature trigger event occurring; and conducting any feature game to which the current value of the feature counter corresponds.

In an embodiment, the designated counter event is the completion of a designated number of game rounds in the base game.

In an embodiment, the designated number is one.

In an embodiment, the designated number is two.

In an embodiment, the designated counter event is the occurrence of a symbol combination in the base game.

In an embodiment, different ranges of counter values are allocated to each of the plurality of feature games, and the determination as to whether a feature game corresponds to the current value of the counter is based on the allocated ranges.

In an embodiment, at least one range of counter values is not allocated to a feature game such that if the current counter value is within that range when a feature trigger event occurs, a feature game is not conducted.

In an embodiment, the feature counter is modified by subtraction.

In an embodiment, the feature counter is modified by addition.

In an embodiment, the feature counter represents a time period and each of the features corresponds to a period in history.

In an embodiment, the random value is determined in a bonus game.

In an embodiment, the bonus game is a spinning wheel game, the wheel having a plurality of segments corresponding to a plurality of values and wherein the wheel is spun and the value determined based on a random stopping position of the wheel.

In an embodiment, wherein the prize value of the feature game is related to the size of the current value of the feature counter.

In an embodiment, the method comprises resetting the feature counter in response to at least a determination that a new game session is to be conducted.

In a second aspect the invention provides a game controller comprising a feature counter, the game controller arranged to:

conduct a base game;

modify a current value of a feature counter by a random value in response to a designated counter event occurring in the base game;

determine whether the current value of the feature counter corresponds to one of a plurality of feature games in response to a feature trigger event occurring; and conduct any feature game to which the current value of the feature counter corresponds.

In an embodiment, the game controller comprises a modification module arranged to modify the feature game counter by a random value.

In an embodiment, the game controller comprises an available feature module arranged to carry out the determination of whether a current value of the feature counter corresponds to one of a plurality of feature games in response to a feature trigger event occurring in the base game.

In an embodiment, the designated counter event is the completion of a designated number of game rounds in the base game.

In an embodiment, the designated counter event is the occurrence of a symbol combination in the base game.

In an embodiment, different ranges of counter values are allocated to each of the plurality of feature games, and the determination as to whether a feature game corresponds to the current value of the counter is based on the allocated ranges.

In an embodiment, at least one range of counter values is not allocated to a feature game such that if the current counter value is within that range when a feature trigger event occurs, a feature game is not conducted.

In an embodiment, the feature counter is modified by subtraction.

In an embodiment, the feature counter is modified by addition.

In an embodiment, the feature counter represents a time period and each of the features corresponds to a period in history.

In an embodiment, the game controller comprises a bonus game module for conducting a bonus game to determine the random value.

In an embodiment, the bonus game is a spinning wheel game, the wheel having a plurality of segments corresponding to a plurality of values and wherein the wheel is spun and the value determined based on a random stopping position of the wheel.

In an embodiment, the prize value of the feature game is related to the size of the current value of the feature counter.

In an embodiment, the game controller is arranged to reset the feature counter in response to at least a determination that a new game session is to be conducted.

In an embodiment, the game controller is implemented, at least in part by a processor executing program instructions stored in a memory.

In a third aspect the invention provides a gaming system comprising:

a player interface; and a game controller comprising a feature counter, the game controller arranged to:

conduct a base game;

modify a current value of a feature counter by a random value in response to a designated counter event occurring in the base game;

determine whether the current value of the feature counter corresponds to one of a plurality of feature games in response to a feature trigger event occurring; and conduct any feature game to which the current value of the feature counter corresponds.

In an embodiment, the player interface comprises a display for displaying play of the base game, the feature counter and any feature game.

In an embodiment, the gaming system comprises a game play mechanism operable by the player to initiate a play of the base game.

In an embodiment, the game controller comprises a modification module arranged to modify the feature game counter by a random value.

In an embodiment, the game controller comprises an available feature module arranged to carry out the determination of whether a current value of the feature counter corresponds to one of a plurality of feature games in response to a feature trigger event occurring in the base game.

In an embodiment, the designated counter event is the completion of a designated number of game rounds in the base game.

In an embodiment, the designated counter event is the occurrence of a symbol combination in the base game.

In an embodiment, different ranges of counter values are allocated to each of the plurality of feature games, and the determination as to whether a feature game corresponds to the current value of the counter is based on the allocated ranges.

In an embodiment, at least one range of counter values is not allocated to a feature game such that if the current counter value is within that range when a feature trigger event occurs, a feature game is not conducted.

In an embodiment, the game controller comprises a bonus game module for conducting a bonus game to determine the random value.

In an embodiment, the bonus game is a spinning wheel game, the wheel having a plurality of segments corresponding to a plurality of values and wherein the wheel is spun and the value determined based on a random stopping position of the wheel.

In an embodiment, the prize value of the feature game is related to the size of the current value of the feature counter.

In an embodiment, the game controller is arranged to reset the feature counter in response to at least a determination that a new game session is to be conducted.

In an embodiment, the game controller is implemented, at least in part by a processor executing program instructions stored in a memory.

In a fourth aspect the invention provides a method of gaming comprising:

conducting a base game;

modifying a current position of a feature indicator by a random amount in response to a designated indicator event occurring in the base game;

determining whether the current position of the feature indicator corresponds to one of a plurality of feature games in response to a feature trigger event occurring; and conducting any feature game to which the current position of the feature indicator corresponds.

In an embodiment, the designated indicator event is the completion of a designated number of game rounds in the base game.

In an embodiment, the designated indicator event is the occurrence of a symbol combination in the base game.

In an embodiment, the random value is determined in a bonus game.

In an embodiment, the bonus game is a spinning wheel game, the wheel having a plurality of segments corresponding to a plurality of values and wherein the wheel is spun and the value determined based on a random stopping position of the wheel.

In a fifth aspect the invention provides a game controller comprising a feature indicator, the game controller arranged to:

conduct a base game;

modify a current position of a feature indicator by a random amount in response to a designated indicator event occurring in the base game;

determine whether the current position of the feature indicator corresponds to one of a plurality of feature games in response to a feature trigger event occurring; and conduct any feature game to which the current position of the feature indicator corresponds.

In an embodiment, the designated indicator event is the completion of a designated number of game rounds in the base game.

In an embodiment, the designated indicator event is the occurrence of a symbol combination in the base game.

In an embodiment, the game controller comprises a bonus game value arranged to conduct a bonus game to determine the random value.

In an embodiment, the bonus game is a spinning wheel game, the wheel having a plurality of segments corresponding to a plurality of values and wherein the wheel is spun and the value determined based on a random stopping position of the wheel.

In a sixth aspect the invention provides a gaming system comprising:

a player interface; and a game controller arranged to:

conduct a base game;

modify a current position of a feature indicator by a random amount in response to a designated indicator event occurring in the base game;

determine whether the current position of the feature indicator corresponds to one of a plurality of feature games in response to a feature trigger event occurring; and conduct any feature game to which the current position of the feature indicator corresponds.

In an embodiment, the designated indicator event is the completion of a designated number of game rounds in the base game.

In an embodiment, the designated indicator event is the occurrence of a symbol combination in the base game.

In an embodiment, the game controller comprises a bonus game value arranged to conduct a bonus game to determine the random value.

In an embodiment, the bonus game is a spinning wheel game, the wheel having a plurality of segments corresponding to a plurality of values and wherein the wheel is spun and the value determined based on a random stopping position of the wheel.

In a seventh aspect the invention provides computer program code which when executed implements any of the above methods.

In an eighth aspect the invention provides a computer readable medium comprising the above program code.

In a ninth aspect the invention provides a data signal comprising the above program code.

In a tenth aspect, the invention extends to transmitting the program code.

BRIEF DESCRIPTION OF THE DRAWINGS

An embodiment of the invention will now be described in relation to the following drawings in which.

DETAILED DESCRIPTION

The embodiment provides a gaming system having a game controller arranged to conduct a base game and each of a plurality of feature games. When a designated counter event occurs in the base game, a feature counter is modified by a random value. If a feature trigger event occurs in the base game it is determined whether a current value of the feature counter corresponds to one of a plurality of feature games. If there is a correspondence, the relevant feature game is conducted.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 1:
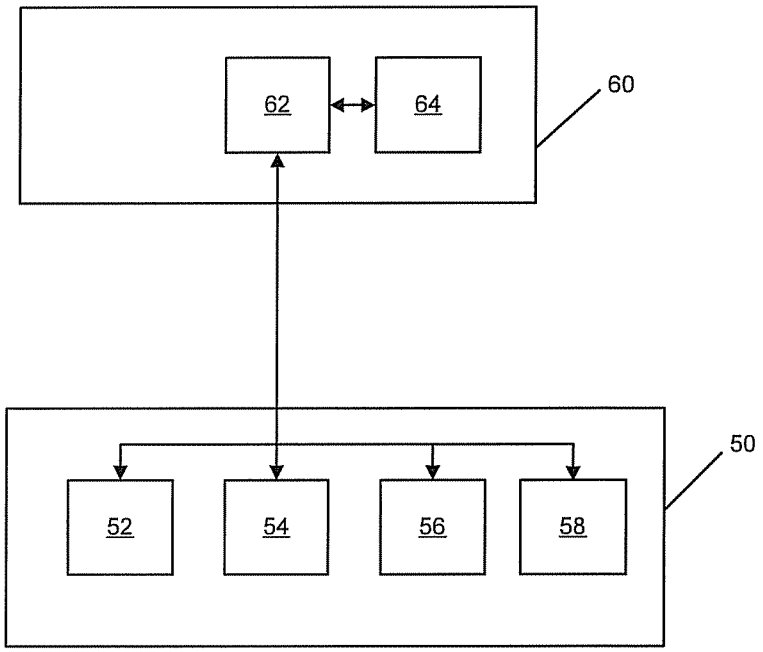
FIG. 1 is a block diagram of the core components of a gaming system.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54, a game play mechanism 56 that enables a player to input game play instructions, and a speaker 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
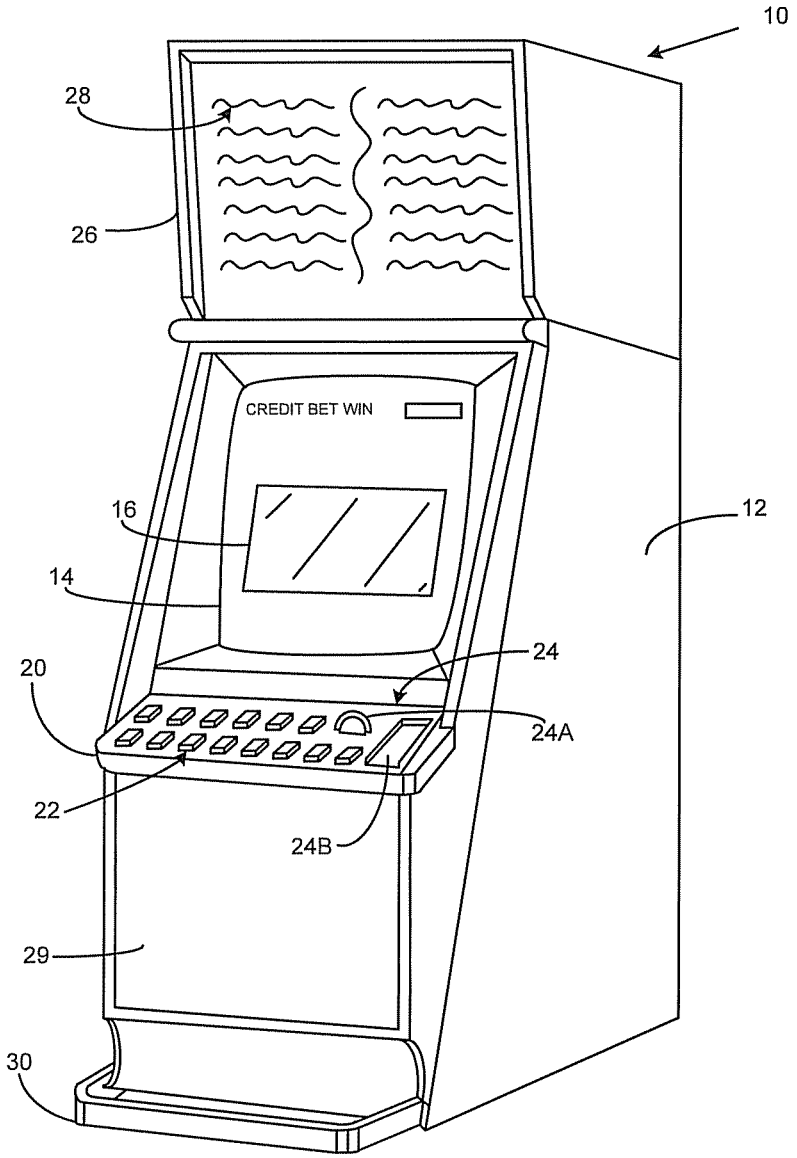
FIG. 2 is a perspective view of a gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module may be provided having a reading device for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
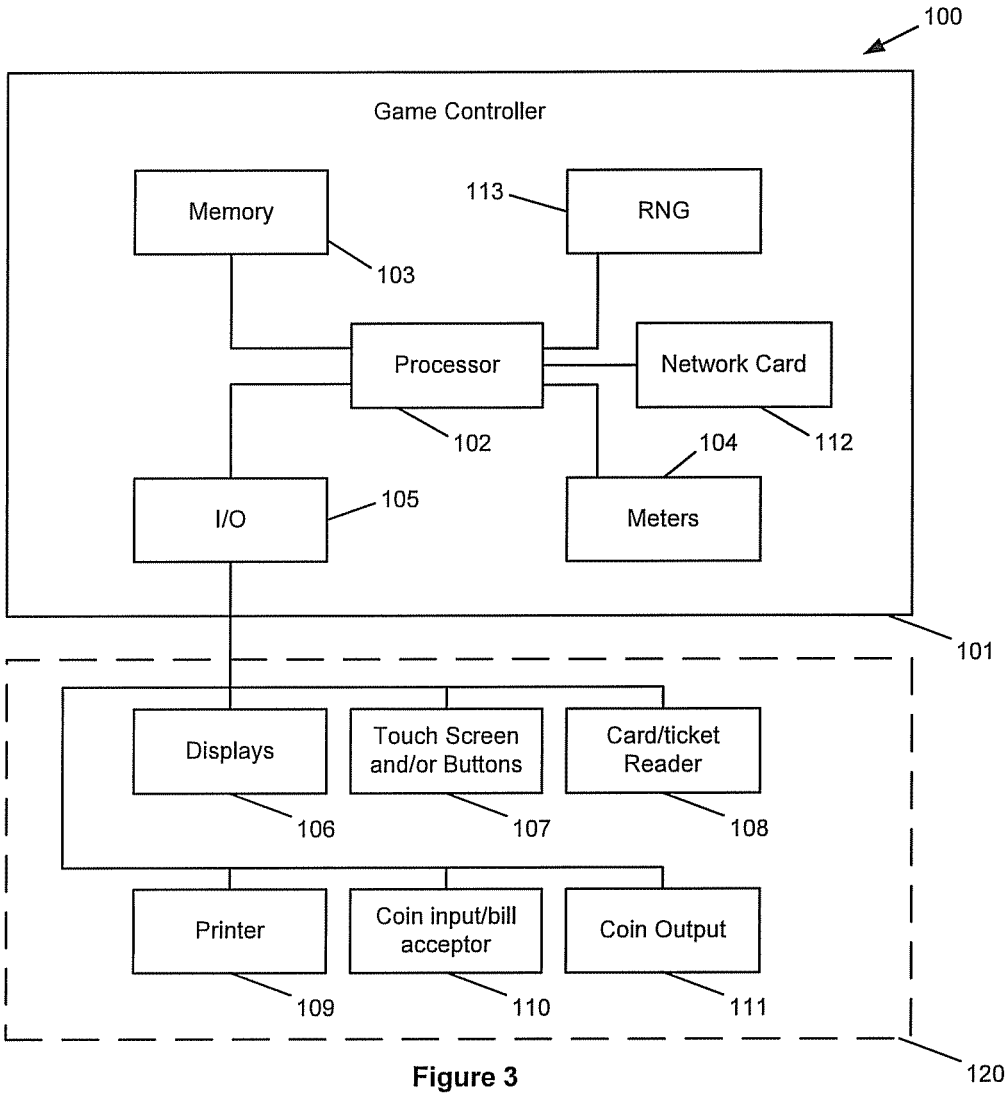
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, buttons and/or a touch screen 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
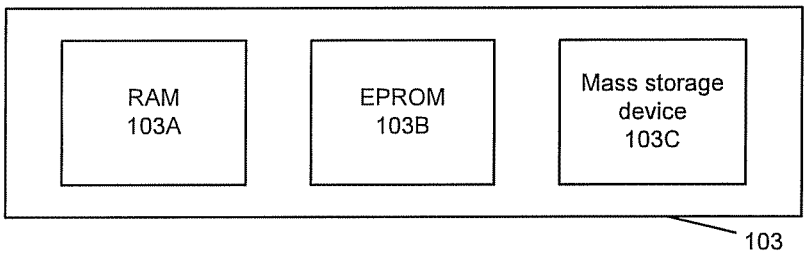
FIG. 4 is a block diagram representing the structure of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
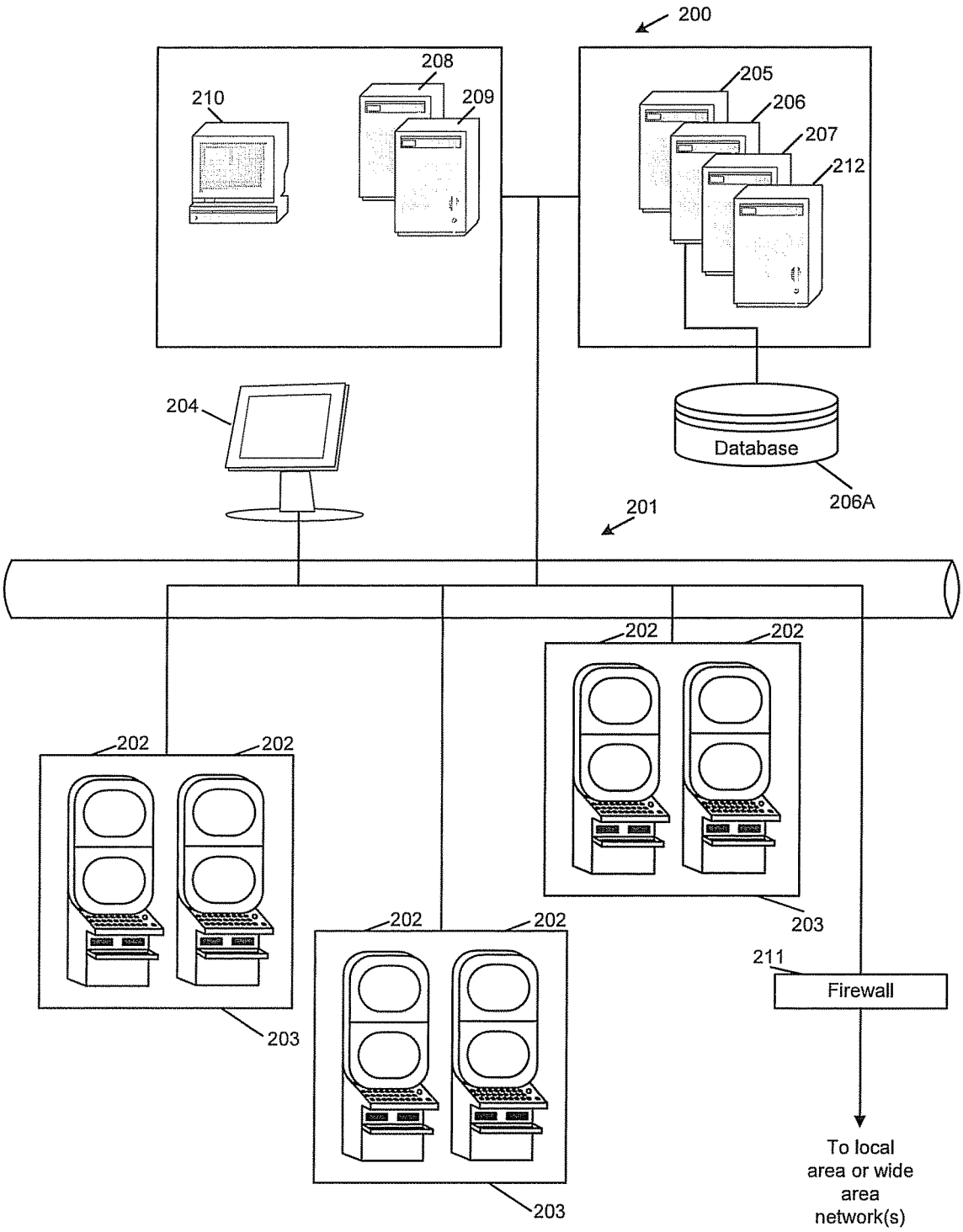
FIG. 5 is a diagram schematic of a networked gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals.

In the embodiment, the base game is a spinning reel type game. Gaming systems for implementing games that involve a display of spinning reels as part of the display of the outcome of a game have either a video display or a mechanical display, these later machines most usually being "stepper" machines which have a separate stepper motor for each reel.

In some implementations the game controllers of such gaming machines select symbols by employing a stop determining function that randomly determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" visible to the player on the display which corresponds to a player playing a single win line. When a reel stops, the symbols will be in one of a plurality of possible symbol positions for that reel relative to the stop position.

Gaming systems typically allow a player to select how many win lines of a plurality of win lines they will play in each game—i.e. a minimum of one win line up to the maximum number of win lines allowed by the game. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. Other techniques for allowing the paler to make a bet are known such as allowing a player to select a number of reels to play.

Figure 6:
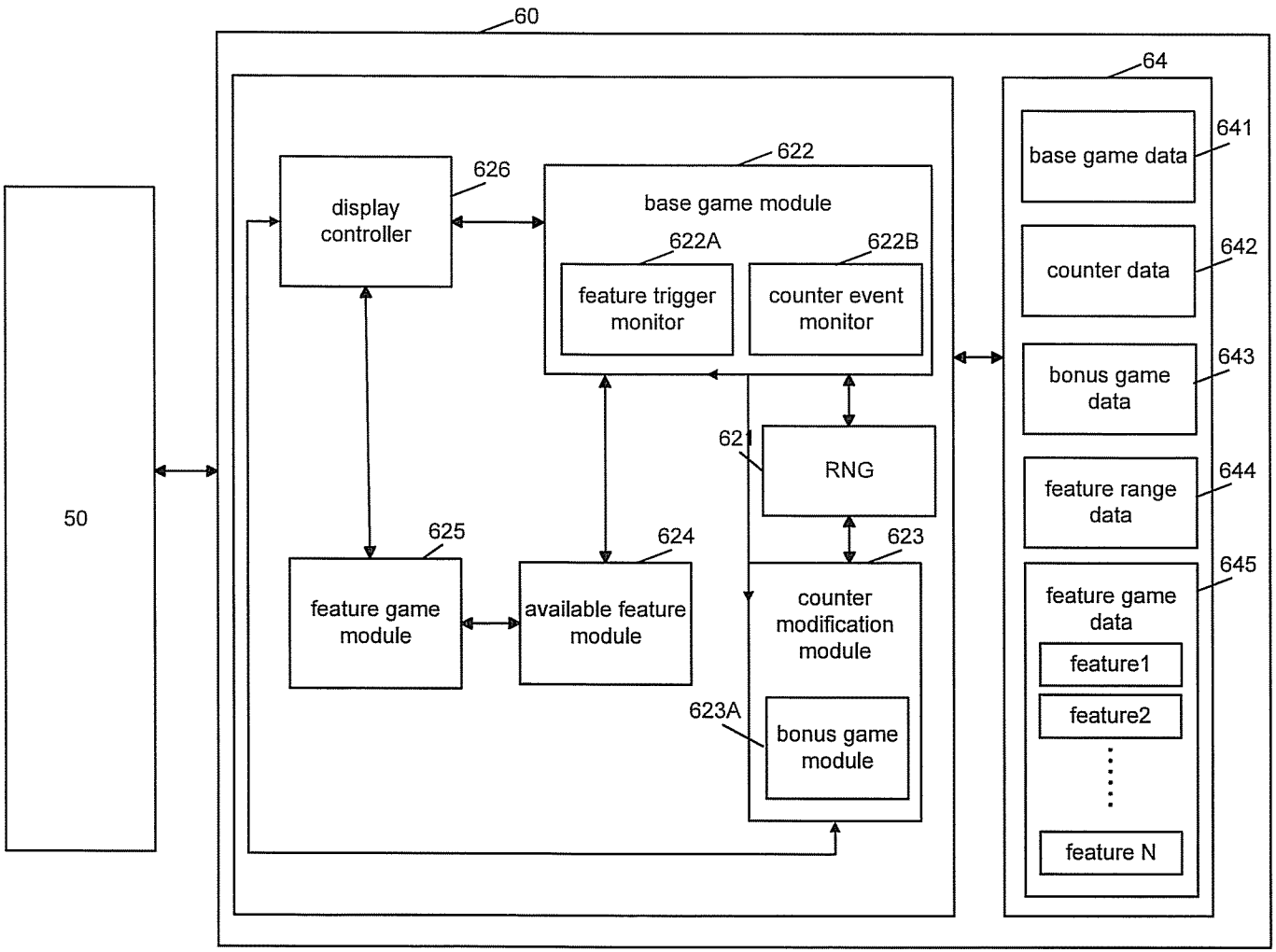
FIG. 6 is a further block diagram of the gaming system.

The game controller 60 of the embodiment is shown in more detail in FIG. 6.

In FIG. 6 a number of modules are implemented by the processor 62 including random number generator 621, base game module 622, counter modification module 623, available feature module 624, feature game module 625 and display controller 626. In this embodiment, the modules are implemented as software executed by the processor. Persons skilled in the art will appreciate that in other embodiments, one or more of the modules may be implemented on a different processor, for example, the random number generator 621 may be implemented on a random number generator server. Further, not all of the modules need be implemented as software executed by a processor and could be implemented by dedicated hardware.

In the embodiment, play of the game including the input of player instructions and the display of the game is via the player interface 50. Initially play begins with a player playing a base game under the control of the base game module 622 which implements the base game in accordance with base game data 641 which as described above will be a spinning reel type game carried out in accordance with techniques known in the art. In this respect it will be appreciated that in one example of a spinning reel type game the base game module 622 will employ the random number generator 621 to select stopping positions for a plurality of reels. During play of the base game, the counter event monitor 622B of the base game module 622 determines whether an event has occurred in the base game which should result in a modification of a counter stored as counter data 642. Depending on the embodiment, the counter may or may not be reset. If the counter is reset, the counter may be reset each time a game session is initiated or each time a gaming machine is not played for a predetermined time depending on the specific embodiment. Depending on the embodiment the counter event monitor 622B can monitor for different counter events including the completion of each game round such that the counter is modified after each game round, the completion of a plurality of game rounds, or the occurrence of a particular symbol or symbol combination during the base game.

Figure 8:
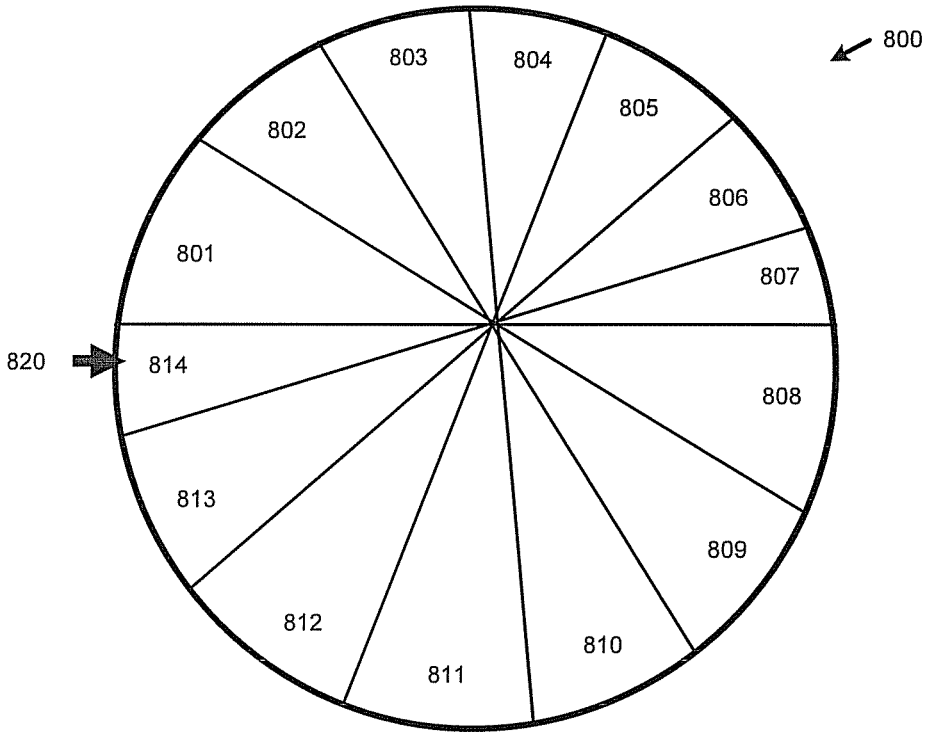
FIG. 8 illustrates an exemplary wheel for a bonus game.

Once the counter event monitor 622B determines that a counter event has occurred, it advises the counter modification module 623 which determines a modification to apply to the current value of the counter stored as counter data 642. In the embodiment, the counter modification module 623 modifies the counter by implementing a bonus game using bonus game module 623A. In the embodiment the bonus game is a wheel game where a wheel 800 is exemplified in FIG. 8 is spun and a random value is obtained to add to the counter depending on the segment 801 to 814 which corresponds to the indicator 820 when the wheel stops. As indicated in FIG. 8, the segments can be of different sizes in order to give different probabilities to various outcomes. Each of the segments 801 to 814 may represent a different value. The value that is spun up with the bonus game wheel is added to the current counter value. The current value of the counter is displayed on display 54 by display controller 626. The size of the segments and the values allocated to each sequence is stored as bonus game data 643.

In the embodiment, the memory 64 also stores feature range data with features allocated to a plurality (N) of ranges (N+1) with one range not allocated to a feature game such that if a feature trigger event occurs during this range a feature game will not be triggered. A person skilled in the art will appreciate that in other embodiments each range of counter values may be allocated to a feature or indeed that there may be a plurality of ranges that are not allocated to a feature game. Typically, the range which does not correspond to a feature game will be the lowest range such that a feature game cannot be awarded shortly after a game session commences and the counter has been reset.

The feature trigger monitor 622A of the base game module monitors outcomes of the base game to determine whether a feature trigger condition has been met.

The feature trigger condition can be in accordance with any one of a number of known rules including but not limited to:

when a special symbol, or a combination of symbols appears in the window;

when a time elapses;

when a system event occurs;

when an underlying random event occurs, for example, in the course of a game; or when a turnover has elapsed.

In other embodiments, the feature trigger could occur independently of the base game, for example, it might be triggered within another feature or by a system.

When it determines that a feature trigger has occurred, the feature trigger monitor 622A initiates the available feature module 624. The available feature module compares the current value of the counter data 642 with the feature range data 644 to determine which of feature games 1 to N is available (or indeed, in some embodiments, that there isn't a feature game is available). The available feature module advises the feature game module 625 which feature game to implement and the feature game module 625 accesses feature game data 645 and accesses relevant feature data 645A, 645B or 645C. The feature game is then conducted by the feature game module 625 displayed on the display of player interface 50 under controller display controller 626. In other embodiments, there may be a plurality of feature game modules and different ones of the modules may operate depending on the determination by the available feature module 624. For example, where the feature game module is a implemented by executing a software routine, different software routines (and hence different software modules) may be executed for each feature.

The feature game may be of any known feature game in the art but could, for example all be spinning reel type games but use different symbols. Alternatively, the feature games may be of different types, for example some games may be selection games, some games may involve the awarding of a jackpot etc.

Figure 7:
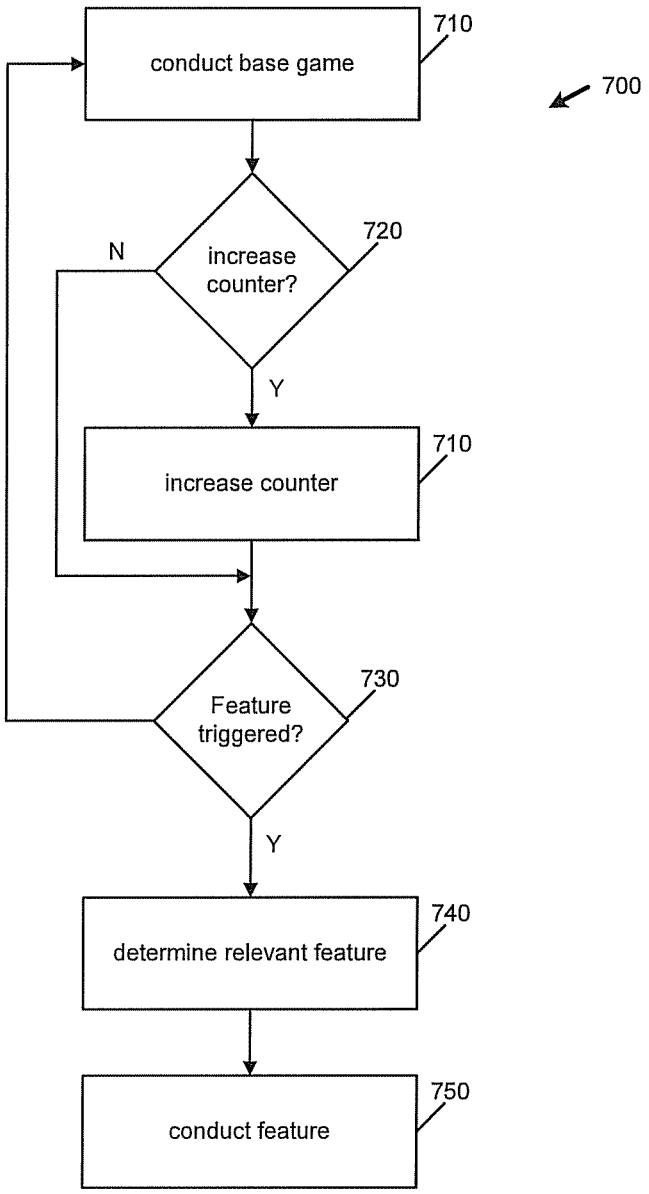
FIG. 7 is a flow chart of an embodiment.

The method 700 of the embodiment is summarised in FIG. 7 which shows that a base game is conducted 710 and is determined 720 whether to modify the counter. If the counter is to be increased it is increased 725 otherwise the method proceeds directly to determining whether the feature has been triggered 730. If the feature is triggered the relevant feature is determined 740 and then conducted 750.

EXAMPLE

Figure 9A:
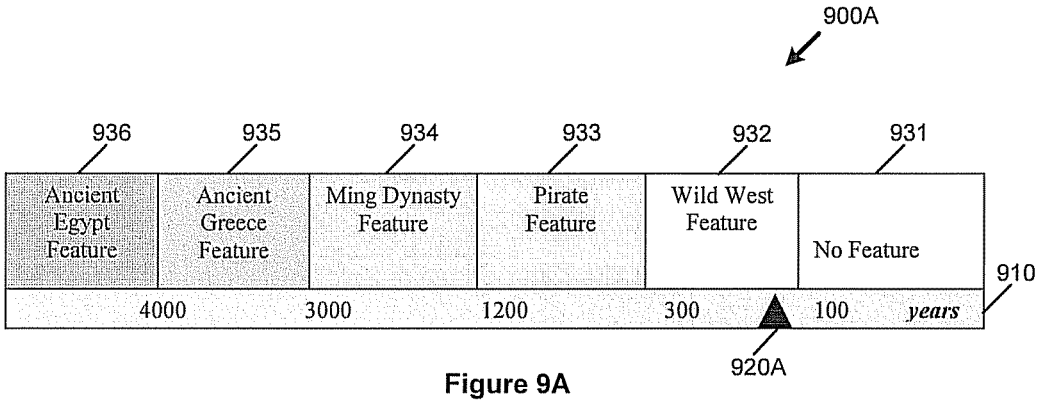
FIGS. 9A to 9C are examples of a display indicating a player's progress towards different feature levels.
Figure 9B:
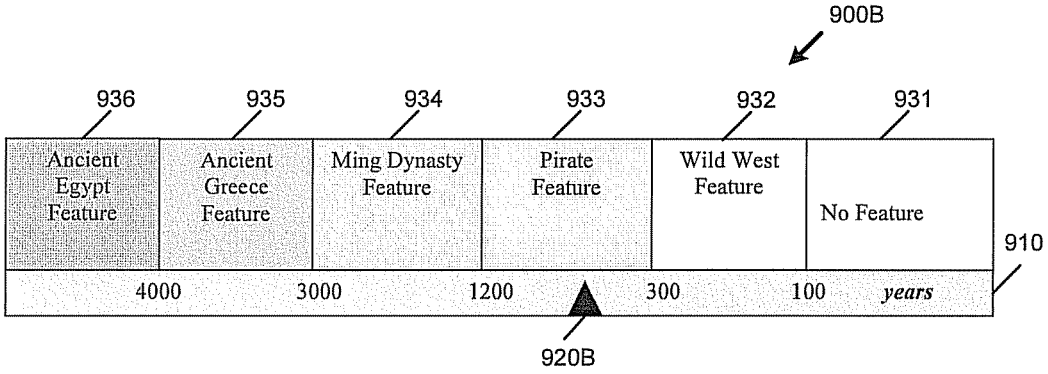
Figure 9C:
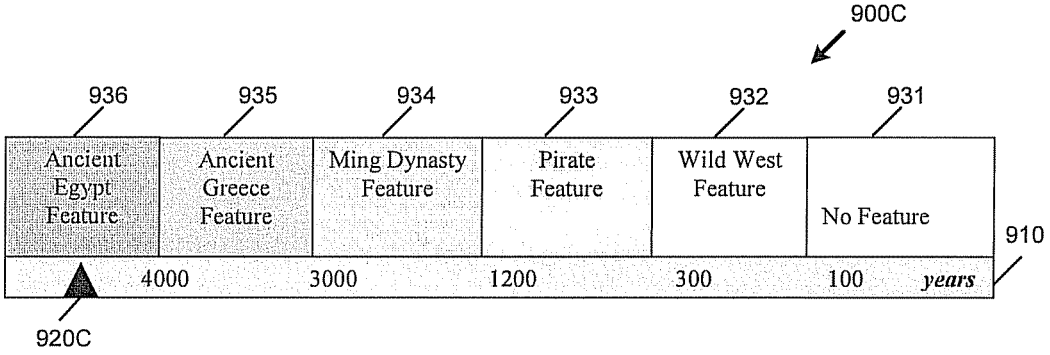

FIGS. 9A to 9C are examples of displays that can be made to a player in order to indicate which feature will be played if a feature is triggered during the base game.

In this example, a theme is applied of how many years back in time the player has progressed. A scale 910 is provided in order that the indicator 920 corresponding to the current value of the feature counter, indicates the position in years backwards from a starting position. Accordingly, the wheel shown in FIG. 8 can be themed to indicate values in terms of numbers of years. In this example, the wheel is spun after each game and the wheel spins up values of 80 years for game 1, 65 years for game 2 and 5 years for game 3, such that after game 3 the indicator is at 150 years back in time as shown in FIG. 9A.

Referring to FIGS. 9A to 9C it will be seen that there are 6 feature game ranges including: first range 931 is 0 to 100 years which corresponds to no feature game; second range 932 of 100 to 300 years which corresponds to a Wild West feature; third range 933 which corresponds to the period of 300 to 1200 years back in time which is a Pirate feature; fourth range 934 which corresponds to a period 1200 to 3000 years back in time which has a Ming Dynasty feature; fifth range 935 which corresponds to the period of 3000 to 4000 years back in time and to an Ancient Greece feature; and a sixth range 936 which corresponds to more than 4000 years back in time and to an Ancient Egypt feature 936.

The game is thus arranged so that the indicator will gradually move back in time for example as illustrated in FIG. 9B the feature game trigger is now within the pirate feature 933 range as indicated by indictor 920B. Accordingly, if the feature trigger, for example 3 scatters, were to occur at that point, the pirate feature will be triggered. As indicated by indicator 920C in the display 900C of FIG. 9C, the indicator continues moving back in time until the last of the features is reached whereafter it remains there until the feature is triggered.

Persons skilled in the art will appreciate that in this example, the indicator is an indirect representation of the counter. In other embodiments, the counter could be directly represented. Further, rather than modifying the indicator indirectly by modifying the counter, embodiments are conceivable where the indicator is directly modified, with reference to FIG. 6 a modified embodiment may be formed by modifying counter modification module 623 to be an indicator modification module and storing the position of the indicator as indicator data instead of counter data 642. It would be understood that in such an embodiment counter event monitor 622B would be understood to be an indicator event monitor—i.e. it would monitor in the same way but result in modification of an indicator instead of a counter.

As indicated above, the secondary feature can be a series of free games, using the same or different reels to those used in the base game or a second screen feature.

A person skilled in the art will appreciate that while the above embodiment has been described in relation to a video display, various other features could be implemented on a mechanical machine. For example, the reel 800 could be a physical reel which is spun mechanically.

The above example is an example where the counter is modified by adding years to a "years back in time" counter. Persons skilled in the art will appreciate that other modifications could be applied. For example, if the scale were to show actual years a subtraction could be applied to move back in time. Other modifications such as multiplication or division could be appropriate with other ranges, for example with exponential scales.

A person skilled in the art will also appreciate that it is not necessary to have a display of the current counter position or that the counter position could be represented in other ways. For example simply by advising which feature is currently available.

Other variations will be apparent to a person skilled in the art and should be understood as falling within the scope of the invention described herein. For example, a spinning reel game, the base game could be a card game or a ball draw game such as Keno, Bingo or Arishinko.

Further aspects of the method will be apparent from the above description of the gaming system. Persons skilled in the art will also appreciate that the method could be embodied in program code. The program code could be supplied in a number of ways, for example on a computer readable medium, such as a disc or a memory (for example, that could replace part of memory 103) or as a data signal (for example, by downloading it from a server).

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of gaming for play of a base game, and a plurality of feature games on a gaming machine having a credit input mechanism configured to receive a physical item associated with a monetary value for establishing a credit balance, the credit balance being increasable and decreasable based at least on wagering activity, a display, a memory having data indicative of the plurality of feature games, credit meters configured to monitor the credit balance, and a game controller having 1) a random number generator and 2) a feature counter having a current value, the base game having a plurality of base game outcomes, at least one of said base game outcomes having a designated counter event, the feature games being associated with a plurality of feature game ranges of values, a payout mechanism configured to provide an award, the method comprising:

establishing a credit balance via the credit input mechanism receiving the physical item;

in accord with having established the credit balance via the credit input mechanism receiving the physical item, conducting the base game;

monitoring, via the game controller, the base game outcomes for an occurrence of said at least one of said base game outcomes having a designated counter event;

generating a random value via said random number generator;

incrementing, via the game controller, the current value of the feature counter by the random value in response to an occurrence in the base game outcome of a designated counter event;

determining, via the game controller, an occurrence of a feature trigger event during play of the base game;

determining, via the game controller, whether the current value of the feature counter corresponds to one of the feature game range of values in response to determining an occurrence of a feature trigger event;

conducting, via the game controller, one of the plurality of feature games which has a range of values corresponding to the current value of the feature counter;

determining, via the game controller, whether the award is to be provided; and in response to determining that the award is to be provided, increasing the credit balance, and providing a payout via the payout mechanism.

2. The method as claimed in claim 1, wherein the designated counter event is a completion of a designated number of game rounds in the base game.

3. The method as claimed in claim 2, wherein the designated number of game rounds is one.

4. The method as claimed in claim 2, wherein the designated number of game rounds is two.

5. The method as claimed in claim 1, wherein the designated counter event is an occurrence of a symbol combination in the base game.

6. The method as claimed in claim 1, wherein at least one feature game range of values is not allocated to a feature game such that if the current counter value is within that range when a feature trigger event occurs, a feature game is not conducted.

7. The method as claimed in claim 6, wherein the feature counter represents a time period and each of the plurality of feature games corresponds to a period in history.

8. The method as claimed in claim 1, wherein the random value is determined in a bonus game.

9. The method as claimed in claim 8, wherein the bonus game is a spinning wheel game having a wheel, the wheel having a plurality of segments corresponding to a plurality of wheel values and wherein the wheel is spun and one of the plurality of wheel values is determined based on a random stopping position of the wheel.

10. The method as claimed in claim 1, wherein the award of at least one of the plurality of feature games is related to the current value of the feature counter.

11. The method as claimed in claim 1, further comprising resetting the feature counter in response to at least a determination that a new game session is to be conducted.

12. A game machine for play of a base game and a plurality of feature games, comprising:

a credit input mechanism configured to receive a physical item associated with a monetary value for establishing a credit balance, the credit balance being increasable and decreasable based at least on wagering activity;

a display;

a memory having data indicative of the plurality of feature games, the feature games being associated with a plurality of feature game ranges of values;

credit meters configured to monitor the credit balance;

a game controller having 1) a random number generator and 2) a feature counter having a current value, the game controller configured to, in accord with having established the credit balance:

conduct the base game, the base game having a plurality of base game outcomes, at least one of said base game outcomes having a designated counter event;

monitor the base game outcome for an occurrence of a said designated counter event;

generate a random value;

increment the current value of the feature counter by the random value in response to an occurrence in the base game outcome of a designated counter event;

determine an occurrence of a feature trigger event during play of the base game;

determine whether the current value of the feature counter corresponds to one of the feature game range of values in response to determining an occurrence of a feature trigger event;

conduct one of the plurality of feature games which has a range of values corresponding to the current value of the feature counter;

determine an award is to be provided; and a payout mechanism configured to provide a payout in accord with the award.

13. The game machine as claimed in claim 12, wherein the designated counter event is a completion of a designated number of game rounds in the base game.

14. The game machine as claimed in claim 12, wherein the designated counter event is an occurrence of a symbol combination in the base game.

15. The game machine as claimed in claim 12, wherein at least one of the feature game ranges of values is not allocated to a feature game, such that if the current value is within the at least one of the feature game ranges of values when the feature trigger event occurs, a feature game is not conducted.

16. The game machine as claimed in claim 12, wherein the feature counter represents a time period and each of the plurality of feature games corresponds to a time period in history.

17. The game machine as claimed in claim 12, wherein said game controller is configured to conduct a bonus game to determine the random value.

18. The game machine as claimed in claim 17, wherein the bonus game is a spinning wheel game having a wheel, the wheel having a plurality of segments corresponding to a plurality of values, and wherein the wheel is spun and the random value is determined based on a random stopping position of the wheel.

19. The game machine as claimed in claim 12, wherein the award of at least one of the plurality of feature games is related to the current value of the feature counter.

20. The game machine as claimed in claim 12, wherein the game controller is further configured to reset the feature counter in response to at least a determination that a new game session is to be conducted.

* * * * *